US009167334B2

(12) United States Patent
Triato

(10) Patent No.: US 9,167,334 B2
(45) Date of Patent: Oct. 20, 2015

(54) ADJUSTABLE MECHANISM FOR SECURING IN-EAR AUDIO DEVICE

(71) Applicant: Patrick R. Triato, Portland, OR (US)

(72) Inventor: Patrick R. Triato, Portland, OR (US)

( * ) Notice: Subject to any disclaimer, the term of this patent is extended or adjusted under 35 U.S.C. 154(b) by 43 days.

(21) Appl. No.: 13/746,202

(22) Filed: Jan. 21, 2013

(65) Prior Publication Data

US 2014/0205125 A1 Jul. 24, 2014

(51) Int. Cl.

| | |
|---|---|
| ***H04R 1/02*** | (2006.01) |
| ***H04R 9/06*** | (2006.01) |
| ***H04R 1/10*** | (2006.01) |
| *H04R 25/00* | (2006.01) |

(52) U.S. Cl.

CPC ..... *H04R 1/105* (2013.01); *H04R 1/1066* (2013.01); *H04R 25/00* (2013.01); *H04R 25/65* (2013.01); *H04R 2225/021* (2013.01); *H04R 2225/63* (2013.01)

(58) Field of Classification Search

CPC ..... H04R 2225/63; H04R 25/65; H04R 2225/021; H04R 25/00; H04R 1/105; H04R 1/1066

USPC ..... 381/333

See application file for complete search history.

(56) References Cited

U.S. PATENT DOCUMENTS

| | | | | |
|---|---|---|---|---|
| 7,983,439 | B2 * | 7/2011 | Bruckhoff et al. | 381/381 |
| 2004/0267290 | A1 * | 12/2004 | Baker et al. | 606/153 |
| 2009/0180653 | A1 * | 7/2009 | Sjursen et al. | 381/322 |
| 2011/0154867 | A1 * | 6/2011 | Fawcett et al. | 70/58 |
| 2012/0085134 | A1 * | 4/2012 | Ezzo et al. | 70/15 |

* cited by examiner

*Primary Examiner* — Matthew Eason
*Assistant Examiner* — Sean H Nguyen
(74) *Attorney, Agent, or Firm* — Mersenne Law

(57) ABSTRACT

Adjustable single-ear headsets or earpieces have an earplug portion to be inserted in the user's ear canal, a body portion to rest in the user's outer ear, and an adjustable securing loop to encircle the user's pinna, the loop adjusted by a rotary mechanism to change the size or shape of the loop and hold the earpiece securely in the user's ear.

11 Claims, 6 Drawing Sheets

Fig. 1
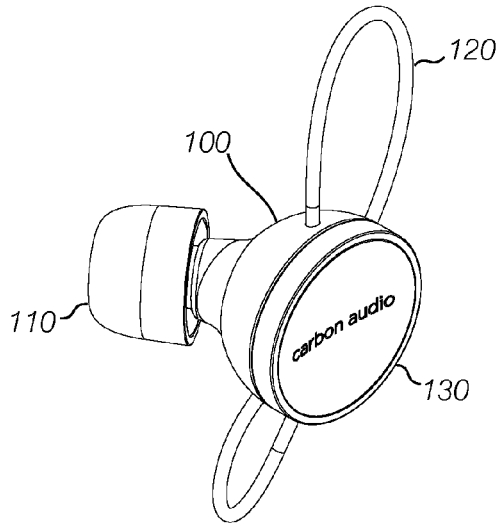
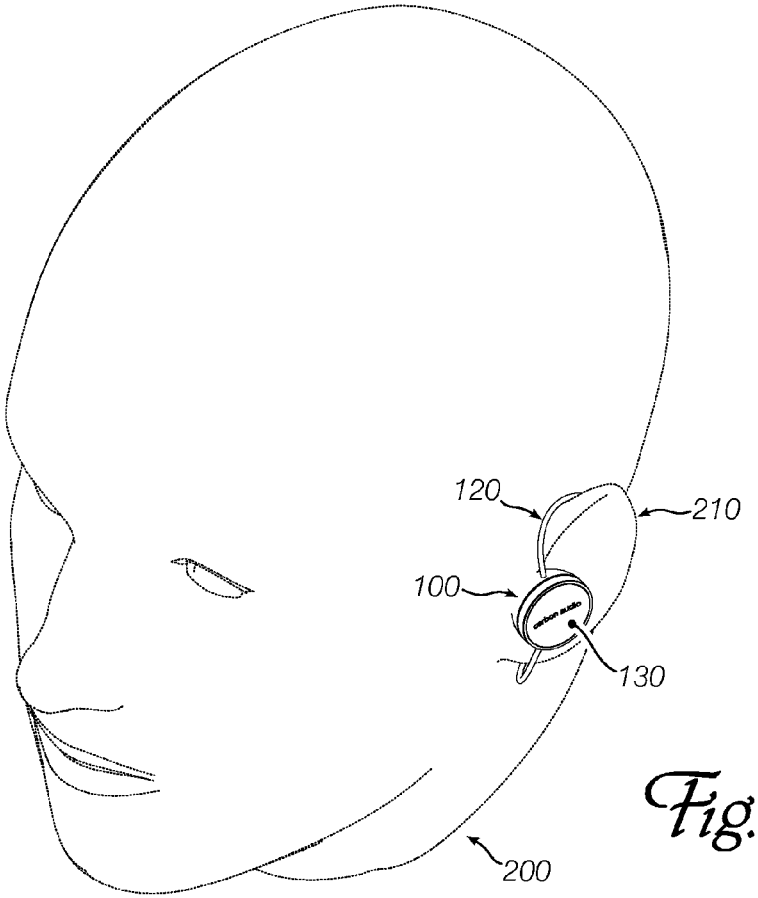
Fig. 2

Fig. 5A
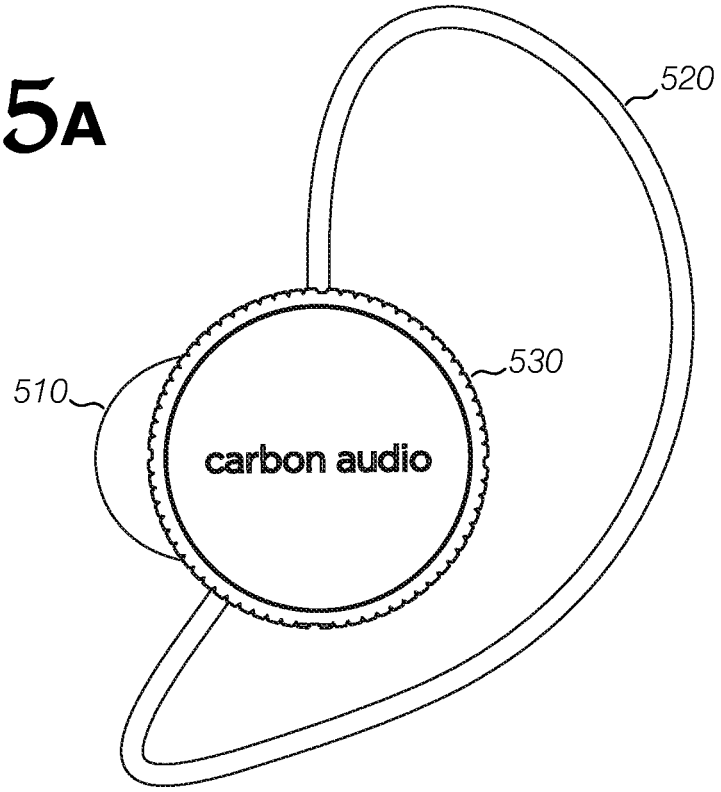
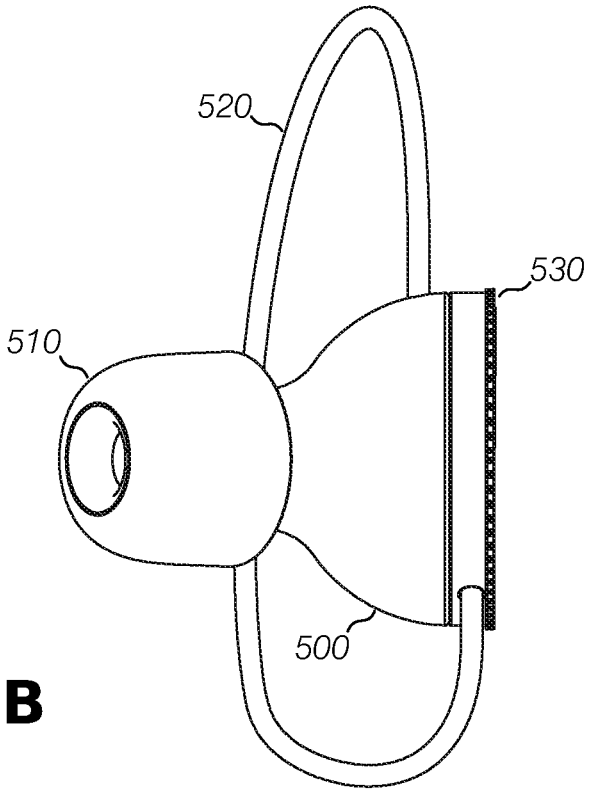
Fig. 5B

ADJUSTABLE MECHANISM FOR SECURING IN-EAR AUDIO DEVICE

CONTINUITY AND CLAIM OF PRIORITY

This is an original U.S. patent application.

FIELD

The invention relates to electro-acoustic audio transducers having head-engaging elements which hold the transducer for reproducing sound signal signals, against an ear of a user. More specifically, the invention relates to support structures which engage the exterior of the user's ear, i.e., the pinna.

BACKGROUND

Headsets, headphones and in-ear hearing aids are available in a wide variety of styles and configurations, reflecting different engineering choices for addressing the multitude of design constraints that must be satisfied to create a functional, reliable, comfortable and attractive product. For example, binaural headphones with over-the-head or behind-the-neck tensioning bands may clamp in place securely, but the bands may interfere with articles of clothing. Similarly, the wires of wired headphones may tangle or catch on the user's surroundings, pulling the headphones off (or out).

One popular headphone style is the "earbud," a small audio transducer (or pair of transducers) sized and shaped to rest in (and/or just outside) the user's outer ear canal. However, many people cannot wear earbuds: their ears are not shaped to hold them securely, or movement of their ears during conversation or other activities tends to cause the earbuds to fall out.

Many in-ear hearing aids are worn similarly to earbuds, but because such aids are often more important to their wearer's everyday life activities (vs. merely providing entertainment—music—or hands-free capabilities for a phone conversation) the hearing aids may be custom-molded to fit their wearer's ears, and may also extend further into the ear canal to provide a more secure attachment. This custom aspect tends to increase the cost of such headsets, placing them out of reach for casual use. (Inexpertly-molded headsets may also be uncomfortable for long-term wear.)

A new headset configuration that provides secure attachment and comfort during extended wear, without requiring expensive individual customization, may be of significant value in this field.

SUMMARY

Mass-producible audio earpieces in one-size-fits-many configurations include an earplug portion to fit the user's ear canal, a body portion containing audio transducers and optionally control/processing circuitry and power sources; and a securing loop to wrap around the user's outer ear (pinna), said securing loop to be adjusted in length, shape and/or angle by operation of an adjuster mechanism of the earpiece.

BRIEF DESCRIPTION OF DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

FIG. 1 shows a perspective view of an embodiment of the invention.

FIG. 2 shows a model's head with an embodiment of the invention attached to its ear.

FIGS. 5A and 5B show two different views of another embodiment of the invention.

DETAILED DESCRIPTION

Figure 3A:
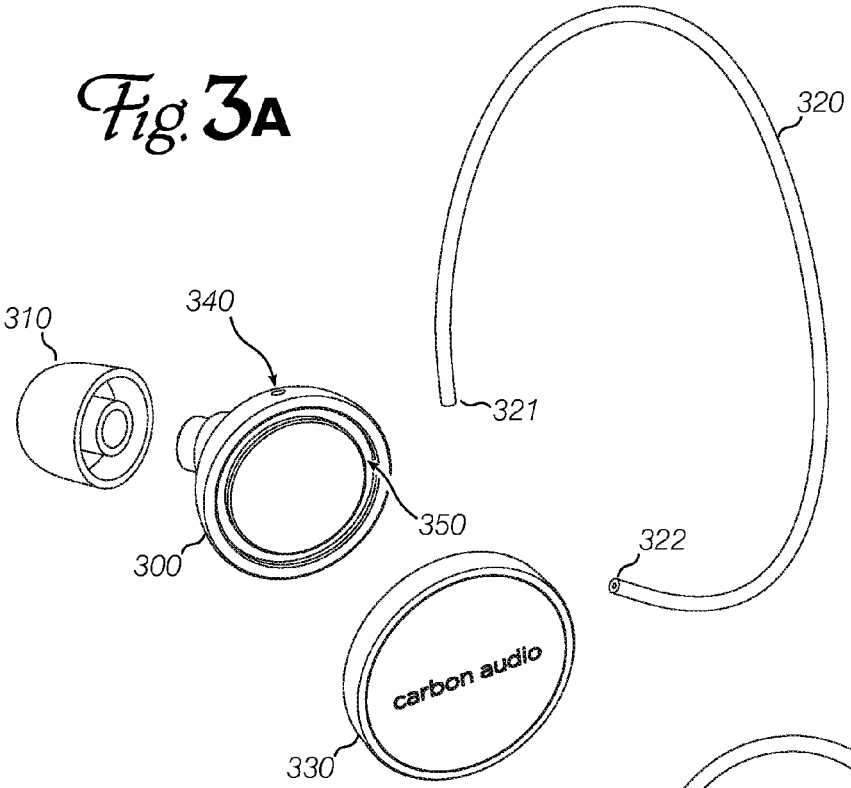
FIGS. 3A and 3B show two different perspectives of an exploded view of an embodiment.

FIG. 1 shows a perspective view of one embodiment, with several features common to most embodiments identified. A central body portion 100 is sized and shaped to rest comfortably in a user's outer ear. The body may be molded in one common size, or a small number of different sizes; it need not be custom-molded to fit each individual user. The body may be formed of a plastic such as nylon, ABS, high-density polyethylene ("HDPE") or another suitable material. It may be coated with rubber or a rubber-like material, or with a sheath or skin of silicone.

An earplug portion 110 is connected to the body, and is constructed to be compressed and inserted at least part way into the user's ear canal. Some embodiments may have replaceable earplug tips comprising flexible rubber "mushrooms" or latex foam pads surrounding a hollow sound-carrying tube from the body. A securing loop 120 is attached to the body at two points, and between the attachments extends outside the body far enough so that the user's outer ear ("pinna") can be inserted between the body and the loop. Finally, this embodiment has an adjuster 130 in the form of a disc portion of the body. Adjuster 130 can be twisted to adjust the position, shape and/or length of securing loop 120 so that the embodiment is held in place in the user's ear. FIG. 1 shows a left-ear version of the embodiment; a version to be worn in the right ear would be a mirror image of it. More generally, only left-ear versions are shown in these Figures.

FIG. 2 shows the embodiment of FIG. 1 as it would be worn by a user 200. The earplug is completely hidden and the body portion 100 is mostly obscured by the user's outer ear, but securing loop 120 is clearly visible extending from the body, up to the point where it wraps around the user's pinna 210. The adjuster disc 130 is also visible in this view.

Figure 3B:
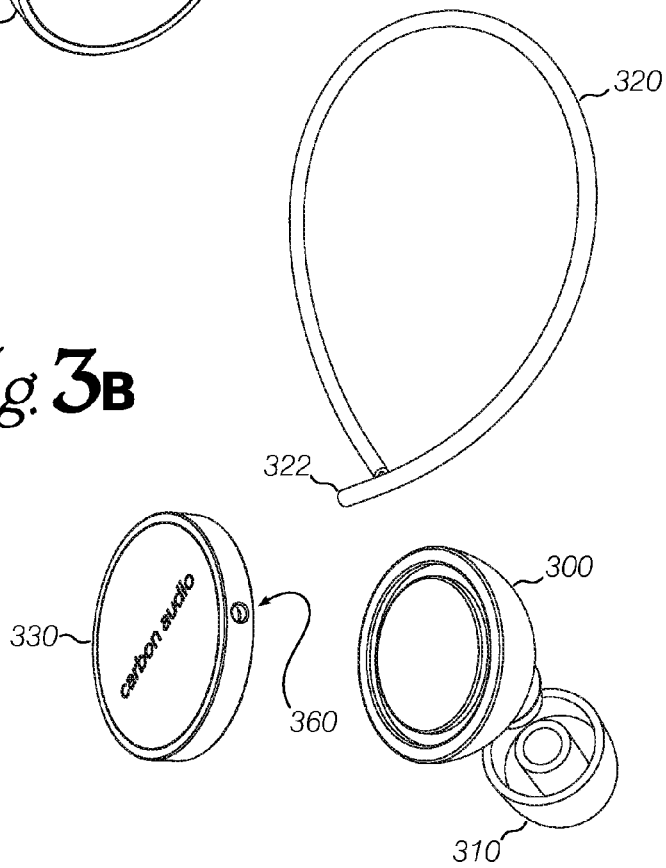

FIGS. 3A and 3B show an exploded view of an embodiment from two different perspectives. In FIG. 3A, body portion 300, earplug portion 310, securing loop 320 and adjuster disc 330 have been separated to show ends 321 and 322 of loop 320, and receptacle 340 in body 300 which is adapted to accept end 321 of the securing loop. In this embodiment, a protruding ring on a back surface of adjuster 330 (not visible in this view) is adapted to fit into corresponding depression or indentation 350 in body portion 300. When so assembled, the adjuster disc may be rotated to change the position, size and/or length of securing loop 320.

FIG. 3B shows the same embodiment from a different angle. Most of the identified components are as described above, but in this view, a second receptacle 360 in adjuster disc 330 is visible. This receptacle accepts end 322 of securing loop 320. In this embodiment, adjuster disc 330 rotates relative to body 300, so the angle between ends 321 and 322 also changes. This change in angle causes a corresponding shape in the securing loop, as shown and described below.

Figure 4A:
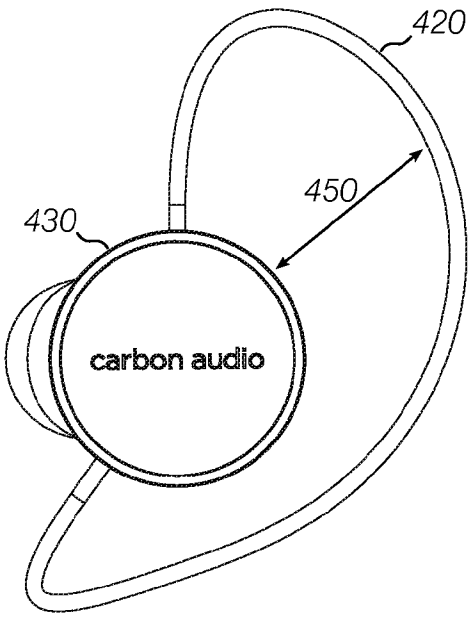
FIGS. 4A-C show how an embodiment may be adjusted to suit a user.
Figure 4B:
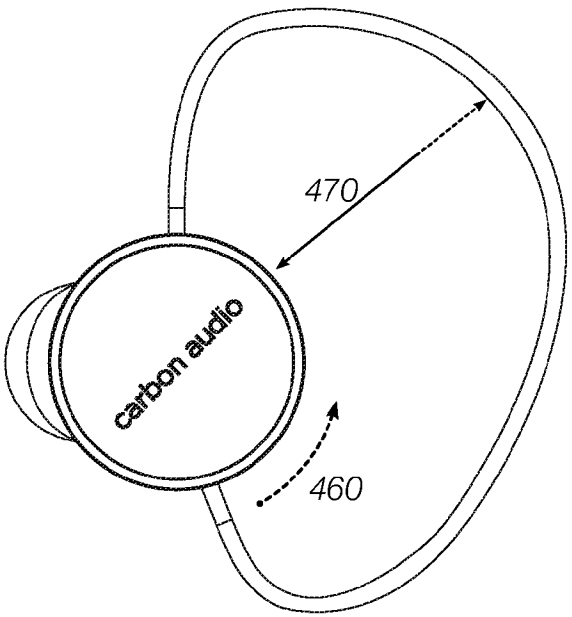
Figure 4C:
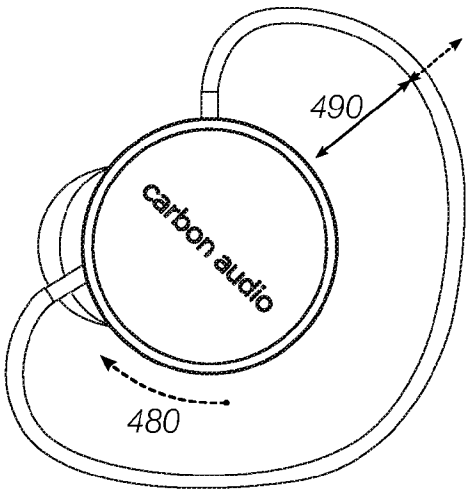

FIGS. 4A through 4C show an outside view of a left-ear embodiment of the invention in three different adjustment positions. In center FIG. 4A, adjuster 430 is in a neutral position (note the horizontal logo text) and securing loop 420 assumes the shape shown. One distance from the outside of the body to the securing loop is marked as 450. In FIG. 4B, the adjuster has been twisted counterclockwise, 460, altering the shape of the securing loop and increasing the body-to-loop distance 470. In FIG. 4C, the adjuster has been twisted an approximately equal angle in the opposite (clockwise) direction, 480, reshaping the securing loop again and reducing the body-to-loop distance 490 (effectively tightening the loop).

In this embodiment, the adjuster changes the angle between one end of the securing loop (where it leaves roughly perpendicularly from the body) and the other end of the securing loop (where it leaves roughly perpendicularly from the adjuster disc).

Note that the mirror image embodiments to fit the other (right) ear may use adjustments/twisting in the opposite direction to perform the loosening and tightening actions.

The securing loop of an embodiment may be made of a flexible material having some stiffness against bending and some compression/tension strength. A material such as a stranded steel cable (preferably covered by a vinyl or silicone sheath) or a thick-walled polyethylene tube is suitable. Other materials may also serve. For example, in one embodiment, the body, securing loop and adjustment disc may be molded at once of a single material such as nylon, ABS plastic or high-density polyethylene ("HDPE").

FIGS. 5A and 5B show side and front views of another embodiment. In side view 5A, the earplug portion is partially visible at 510. The body is obscured by knurled adjuster 530, but securing loop 520 can be seen. FIG. 5B is produced by rotating the embodiment approximately 90° about its vertical axis. More of earplug portion 510 is visible here, as is most of body portion 500.

Although the embodiment of FIGS. 5A and 5B is superficially similar to the embodiments shown earlier, its adjustment mechanism functions differently. Here, the body houses a reel which can take up or release a length of cable that comprises the securing loop. The reel is turned by the knurled adjuster 530. In this embodiment, only the outer ring of the adjuster rotates; the center of the disc functions as a clutch or release mechanism that, when pressed, releases the reel so that the adjustment loop can be expanded easily.

Figures 6A, 6B, 6C:
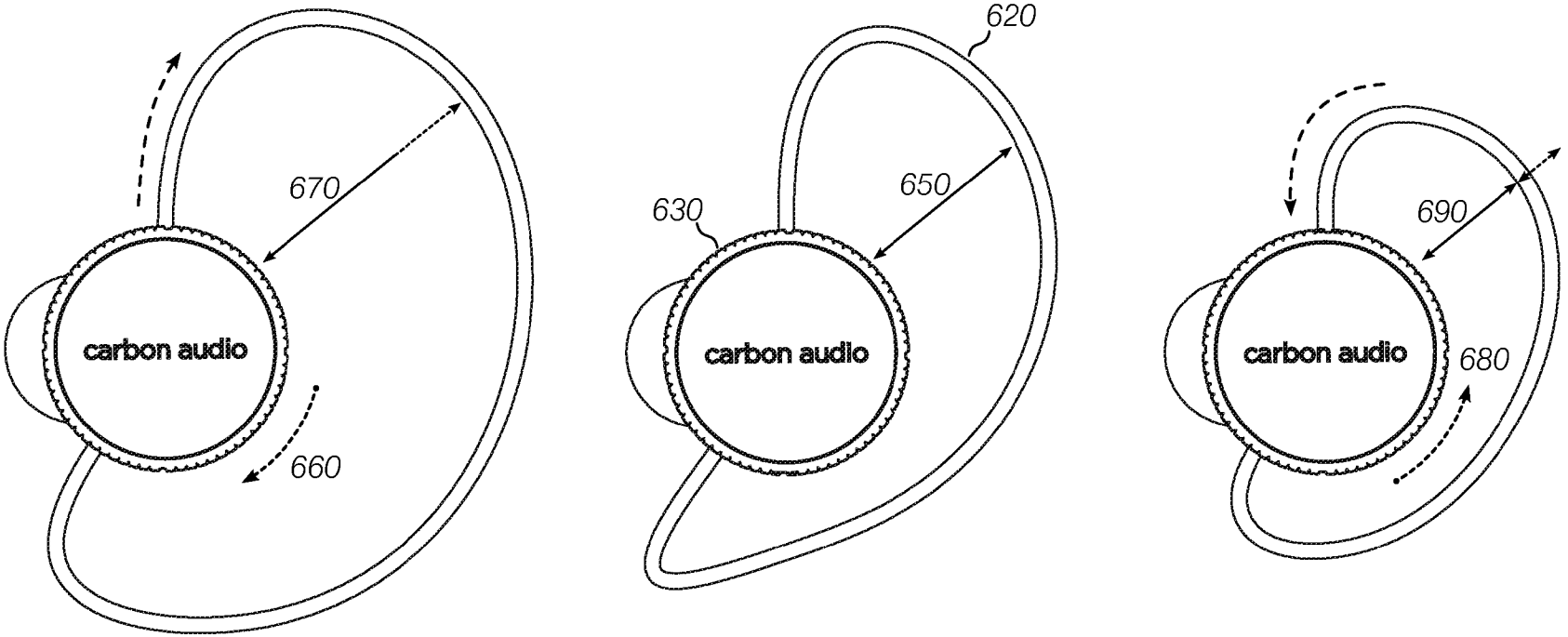
FIGS. 6A-C show how the embodiment of FIGS. 5A and 5B may be adjusted.

FIGS. 6A-6C show the effect of this adjustment mechanism on the securing loop. Center FIG. 6A shows an intermediate adjustment position with one body-to-securing-loop distance marked at 650. If the knurled ring 630 is twisted counterclockwise (FIG. 6B, 660), additional cable is expelled from the reel to expand the securing loop (670). If the knurled ring is twisted in the other direction (FIG. 6C, 680), the securing loop cable is taken up on the reel, so the portion of the loop outside the body is shortened and the body-to-loop distance 690 is decreased.

Alternate mechanisms may be used to implement a varying-length loop as described here. For example, the adjuster may change the tension of a coil spring that pulls the securing loop into the body, or an end of the securing loop may be pulled in (or pushed out) by a cam- or spiral-track-following element.

Embodiments may be constructed as wired earbud replacements, where each earpiece contains only an audio driver (or a plurality of drivers), the audio signal being produced and amplified elsewhere, and sent to the earpieces via ordinary multi-conductor wires. However, in a preferred embodiment, the body portion of the earpiece contains a power source (e.g., batteries), a wireless receiver (e.g., radio or Bluetooth® receiver), and audio processing and amplification circuitry, in addition to the audio driver(s) that produce the sound to be delivered into the user's ear canal. Such a wireless embodiment may comprise user controls (e.g., volume and/or sound quality) on each earpiece, or may rely on audio processing controlled at the device that transmits wirelessly to the earpieces.

Figure 7:
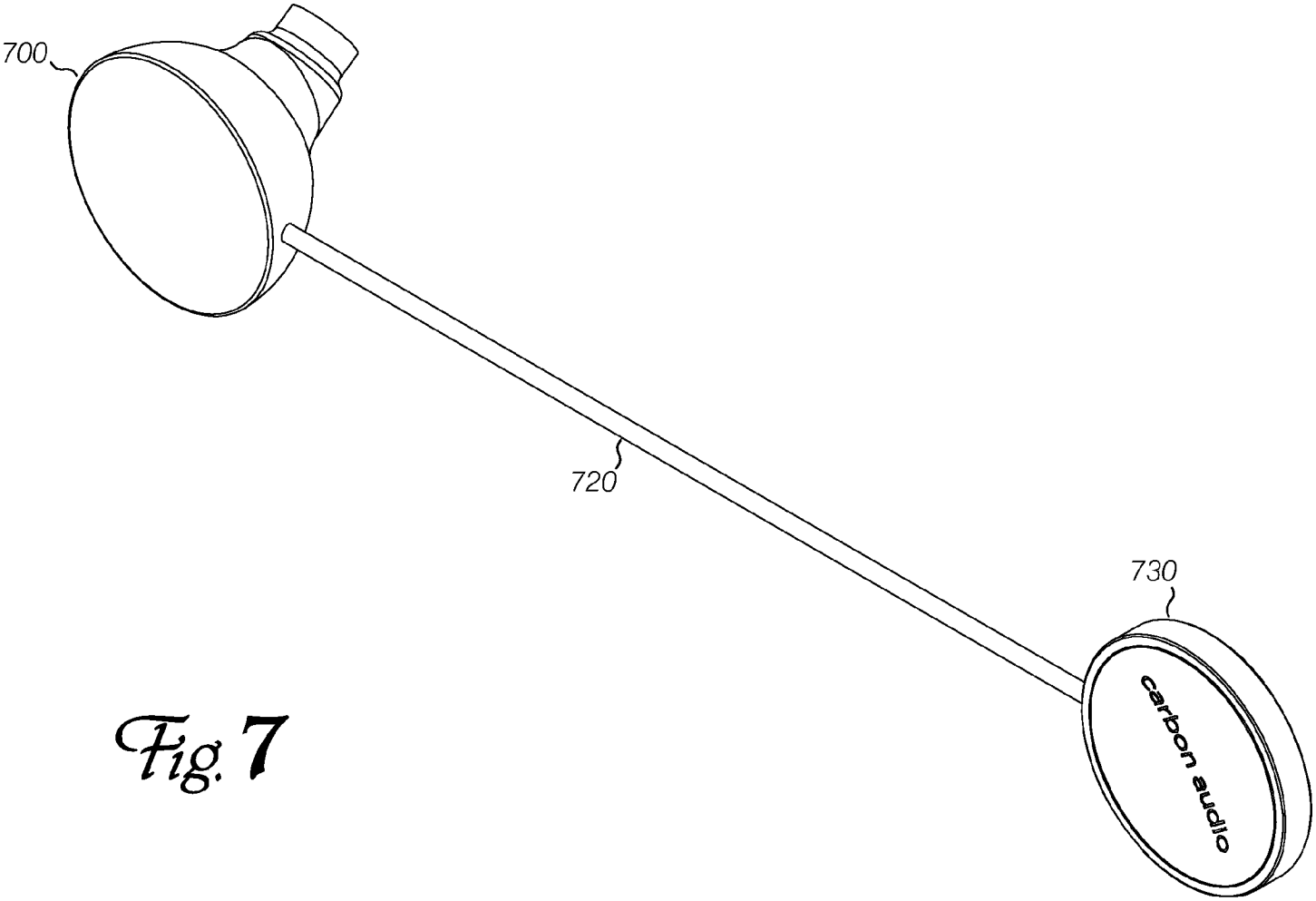
FIG. 7 shows a single-mold embodiment.

In some of the foregoing Figures, embodiments have been shown and/or described as comprising several separate portions. It should be understood that these separations are primarily functional, rather than necessarily physical. For example, the earplug portion of an embodiment need not be a separate component from the body portion; it may be merely an extension of the body that is sized, shaped and composed of materials suitable for comfortable insertion into the user's ear canal. Similarly, the securing loop need not be an independent component inserted into holes in the body and/or adjusting disc; instead, it may be a length of material molded together with the body and/or the adjusting disc, so long as the final, assembled earpiece operates and adjusts along the lines described above. FIG. 7 shows an embodiment where the body portion 700, securing loop 720 and adjuster disc 730 are molded as a single unit. During assembly, after circuitry and audio drivers are inserted into the body's shell, the securing loop is curled around and the adjuster disc is snapped onto the body cavity to cover it and to adjust the shape of the securing loop as described above.

The features and characteristics of the present invention have been described largely by reference to specific examples and in terms of particular configurations of components. However, those of skill in the art will recognize that self-securing earpieces according to an embodiment can also be constructed of components arranged differently than herein described. Such alternate arrangements and variations are understood to be captured according to the following claims.

I claim:

1. An adjustable, self-securing audio earpiece comprising:

an earplug portion adapted for at least partial insertion into an outer ear canal of a user;

a body portion contiguous with the earplug portion, said body portion adapted to rest at least partially in an outer ear of the user; and a securing loop contiguous with the body portion at two points, said securing loop extending outside the body portion far enough to accommodate insertion of the user's pinna; and an adjustment mechanism comprising a circular disc adapted to rotate relative to the body portion, wherein activation of the adjustment mechanism is operative to alter a shape of the securing loop outside the body portion without altering a length of the securing loop outside the body portion.

2. The adjustable, self-securing audio earpiece of claim 1 wherein:

the securing loop connects with the body portion at a first point, and the securing loop connects with the circular disc at a second point, so that rotating the circular disc relative to the body portion alters an angle between a first end of the securing loop near its connection to the body portion at the first point, and a second end of the securing loop near its connection to the circular disc at the second point.

3. The adjustable, self-securing audio earpiece of claim 1 wherein:

one end of the securing loop is inserted into the body portion at a first receptacle; and another end of the securing loop is inserted into the circular disc at a second receptacle.

4. The adjustable, self-securing audio earpiece of claim 1 wherein the earplug portion comprises a removable, flexible rubber mushroom-shaped tip.

5. The adjustable, self-securing audio earpiece of claim 1 wherein the earplug portion comprises a removable latex foam pad.

6. The adjustable, self-securing audio earpiece of claim 1 wherein the body portion and the securing loop are molded in a single unit.

7. An adjustable, self-securing audio earpiece comprising:

a replaceable earplug portion including a latex foam pad surrounding a hollow sound tube, said earplug portion adapted to be inserted into an ear canal of a user;

a molded body shell coupled to the replaceable earplug portion and adapted to fit at least partially in the user's outer ear, said shell containing an audio transducer to emit sound waves into the hollow sound tube;

a securing loop attached to the molded body shell at two locations, said securing loop extending far enough outside the molded body shell to accommodate insertion of the user's pinna; and a rotary adjuster coupled to the molded body shell and operative to change a shape of the securing loop without altering a length of the securing loop outside the molded body shell.

8. The adjustable, self-securing audio earpiece of claim 7, further comprising:

an audio amplifier in the molded body shell, said amplifier to provide an amplified audio signal to the audio transducer;

a wireless receiver in the molded body shell, said wireless receiver to extract an audio signal from a wireless signal and provide the audio signal to the audio amplifier; and a battery in the molded body shell to provide power to the audio amplifier and the wireless receiver.

9. The adjustable, self-securing audio earpiece of claim 8 wherein the wireless receiver is a Bluetooth® receiver.

10. The adjustable, self-securing audio earpiece of claim 7, further comprising:

a user control to adjust a volume of the sound waves emitted by the audio transducer.

11. The adjustable, self-securing audio earpiece of claim 7, further comprising:

a user control to adjust a frequency balance of the sound waves emitted by the audio transducer.

* * * * *